US006490838B2

(12) United States Patent
Summerford

(10) Patent No.: US 6,490,838 B2
(45) Date of Patent: Dec. 10, 2002

(54) ABOVE-GRADE DECKING SYSTEM

(76) Inventor: Jeffry L. Summerford, 519 W. Sierra Madre, Fresno, CA (US) 93705

( * ) Notice: Subject to any disclaimer, the term of this patent is extended or adjusted under 35 U.S.C. 154(b) by 9 days.

(21) Appl. No.: 09/765,845

(22) Filed: Jan. 19, 2001

(65) Prior Publication Data

US 2002/0095897 A1 Jul. 25, 2002

(51) Int. Cl.[7] ..... E04H 12/02

(52) U.S. Cl. ..... 52/650.3; 52/650.3; 52/665; 52/712; 52/714; 52/403.1; 52/582.1; 52/480

(58) Field of Search ..... 52/650.3, DIG. 7, 52/665, 712, 714, 403.1, 480, 582.1

(56) References Cited

U.S. PATENT DOCUMENTS 2,317,428 A * 4/1943 Anderson ..... 52/650.3
5,850,720 A * 12/1998 Willis ..... 52/665
6,128,880 A * 10/2000 Meenan, Jr. ..... 52/650.3

OTHER PUBLICATIONS

Unknown, Trex Decking Composition & Related Materials, from Internet, date published assumed prior to one year before date of application, U.S.

Unknown, A Smarter Deck, Environmental Building News (from Internet), Jul./Aug. 1998, U.S.

Unknown, Another Great Decking Option, Environmental Building News (from Internet), Jun. 1997, U.S.

Unknown, Timbrex, Environmental Building News (from Internet), Mar./Apr. 1993, U.S.

Unknown, General Electric Heating Cable, General Electric Corp., Date unknown but presummed to be more than one year prior to filing date, U.S.

* cited by examiner

*Primary Examiner*—Carl D. Friedman
*Assistant Examiner*—Nahid Amiri
(74) *Attorney, Agent, or Firm*—Richard A. Ryan

(57) ABSTRACT

An above-grade decking system having a plurality of deck members overlying a plurality of joists with clip member connectors connecting the deck members to the joists. The present decking system is particularly adapted for use with concrete composite materials that are shaped into construction materials and textured to resemble wood or stone products. The clip members are shaped to hold the deck members onto the joists. The clip members fit into slots in the deck members and are attached to the joists using commonly available connectors. The deck members can be shaped and configured to fit together with the clip members therebetween.

7 Claims, 3 Drawing Sheets

ABOVE-GRADE DECKING SYSTEM

BACKGROUND OF THE INVENTION

A. Field of the Invention

The field of the present invention relates generally to structural building materials and systems for utilizing the same, specifically such building materials that are made out of concrete but are manufactured to resemble wood boards or stone and systems for installation of the same. More specifically, this invention relates to building materials that are made out of concrete boards that have an appearance similar to standard wood or stone products which are joined together with connectors.

B. Background

Although the apparatus of the present invention is suitable for use with a number of different structures, the discussion in this disclosure will focus on the use of the present invention as a structural material for decking. It is well known that wood and stone are commonly used as building materials to construct a large variety of structures, including backyard decking. Many people prefer wood or stone due to its natural appearance and feel. As a decking material, however, wood does have a number of disadvantages. These disadvantages include the need for preservatives and coatings to protect the wood from exposure to sun, rain and other weather elements. Failure to place these materials on the wood decking when constructed will substantially shorten the structure's life and result in a decking of unsatisfactory appearance after a relatively short time period. In addition to the initial coating of the preservatives, the owner of the decking must ensure that it is properly treated over varying intervals of the life of the decking. Failure to properly maintain the decking will also result in a much shorter life for the decking and decking that is of undesirable appearance. The care of the wood decking requires both an investment in money and time. Stone materials also have a number of disadvantages when used as a decking material. The primary disadvantage has to do with limitations on the size and placement of the stone materials In addition to the care requirements for wood materials set forth above, many people are turning away from wood where acceptable substitutes are available for environmental reasons. The most common wood material used for decking and the like is redwood and cedar. Both these materials are becoming generally less available and, as a result, more expensive to be used as structural materials in relatively large structures (such as decking). In addition, the primary system available for placing these materials in their proper positions are the use of nails, screws and/or bolts of various types. These connectors generally result in the heads or tops of the connectors being visible and, often, protrusions above the surface of the deck or other structure.

A number of different materials have been developed to be used as a structural material in place of wood or stone. These materials include various plastics, metals and concrete. In general, these materials are not utilized as much as standard wood or stone products. The lack of use is primarily due to the less attractive appearance and feel of these materials. In addition, the systems available for installation of these materials are typically less than satisfactory. Recent developments in the use of plastic composites have added a new material that can be used for decking and other structures. The plastic composites are generally manufactured out of a concrete resin, such as recycled polyethylene, and waste wood fibers. The plastic and wood fibers are mixed together and then formed into board-shaped or stone-shaped structural materials that are used for decking and other structural needs as a replacement for wood boards or stone. The use of plastics for building materials has a number of disadvantages, such as the petroleum products from which it is made, the expense and difficulty in making the product and the susceptibility of plastic to damage from the weather elements.

What is needed is a structural material that can serve as a replacement for wood and stone and be used in place of wood and stone for constructing various structures, such as decking. To successfully replace the wood and stone products, the structural material must have the ability to be shaped as a wood member (i.e., a board) or a stone slab, be able to have a color added to it and be durable and weather resistant. A more preferable connector for installing these materials is also needed so as to provide a more secure and attractive system.

SUMMARY OF THE INVENTION

The above-grade concrete decking system of the present invention provides the benefits and solves the problems identified above. That is to say, the present invention discloses a building system that can be used in place of wood and stone building materials, is easy to manufacture, durable and relatively maintenance free. The system used to install the subject building material provides a stable structure, such as a decking, that is easy to install and provides a long life structure.

In its broadest form, the primary embodiment of the present invention comprises a plurality of adjoining deck members overlying a plurality of spaced apart joists that are connected together with a clip member shaped and configured to hold the deck members to the joists. The plurality of deck members comprises at least a first deck member and a second deck member on top of the plurality of spaced apart joists. Each of the deck members has a first side and an opposing second side, a top surface and a bottom surface. At least one of the opposing sides of each deck member has a slot therein. The slot can either be a single slot that runs the length of the deck member or it can be a series of slots that are spaced apart an amount equal to the spacing of the joists. The clip member has at least a base portion, a vertical portion and an insert portion. The various components of the clip member are sized and configured such that the insert portion is disposed in the slot when the base portion is disposed between the bottom surface of the deck member and the joist and the vertical member is disposed between the adjoining deck members. The deck members can be a concrete composite material shaped and configured into a board member that simulates a natural wood finish or shaped and configured into a stone member that simulates a natural stone material.

In one specific configuration, the deck system utilizes a adjoining deck members that have slotted sides that face each other and are intended to abut each other in the finished form. The insert portion of the clip member has extensions that extend away from the vertical portion of the clip member in opposite directions such that the insert portions are disposed in the slots in the opposing sides of the adjoining deck members. To further improve the stability of the decking system, an adhesive can be used between the deck members and the joist. In addition, the base portion of the clip member should have at least one opening therein that is configured to receive a connector, such as a nail, screw, bolt or other connector, to secure the clip member base portion to the joist.

Instead of utilizing slots in the deck members, one embodiment of the present invention utilizes deck members that are shaped and configured to fit together with the clip member (and if desired adhesive material) between the deck members or between the deck members and the joist. In another embodiment, the deck members fit together and include a slot in at least one of the deck members so as to receive the insert portion of the clip member.

Accordingly, the primary objective of the present invention is to provide an above-grade decking system that securely connects the surface deck members to the underlying joists without the need for connectors going through the top of the deck members.

It is also an important objective of the present invention to provide an above-grade decking system that utilizes shaped clip members that are used to secure deck members to underlying joists.

It is also an important objective of the present invention to provide an above-grade decking system that is suitable for securing deck members made out of concrete composite materials, which are shaped into looking like wood or stone products, to joists.

It is also an important objective of the present invention to provide an above-grade decking system that utilizes decking members shaped and configured to fit together with a clip member therebetween.

The above and other objectives of the present invention will be explained in greater detail by reference to the figures and the description of the preferred embodiment which follows. As set forth herein, the present invention resides in the novel features of form, construction, mode of operation and combination of parts presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures and drawings are merely illustrative of the preferred embodiments and represent several different ways of configuring the present invention. Although specific components, materials, configurations and uses are illustrated, it should be understood that a number of variations to the components and to the configuration of those components described herein and in the accompanying figures can be made without changing the scope and function of the invention set forth herein.

Figure 1:
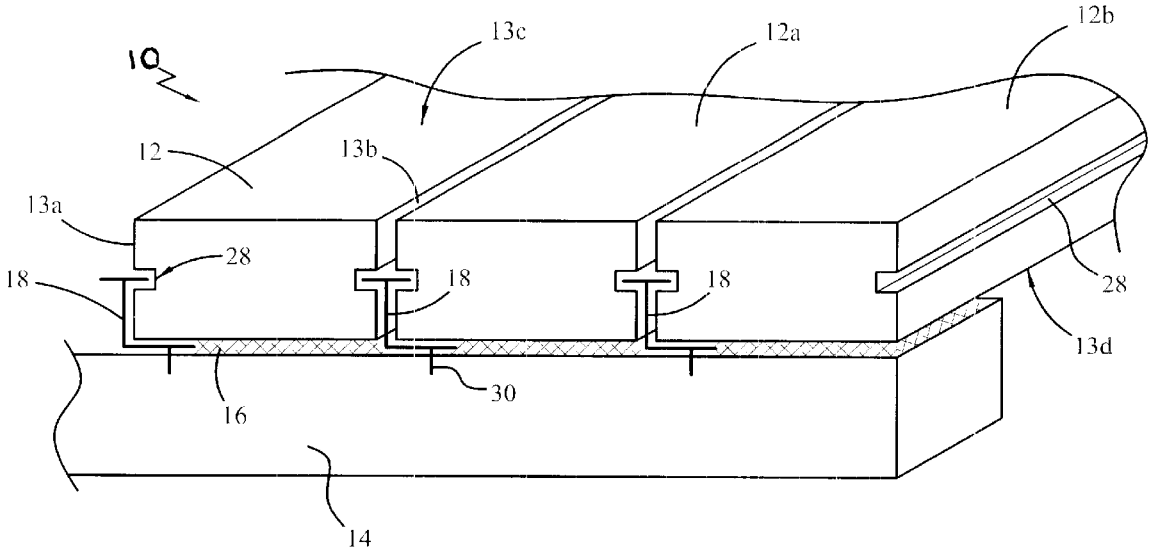
FIG. 1 is a perspective view of a deck utilizing board members made out of the concrete material and utilizing the system described herein.

An above-grade concrete decking system manufactured out of the materials and pursuant to the system of the present invention is shown generally as 10 in FIGS. 1, 5, 7 and 8. As shown in FIG. 1, a typical decking system 10 has a plurality of adjoining deck members 12, comprising at least a first deck member 12*a* and a second deck member 12*b* in the shape of board members (i.e., wood boards) or stone material (i.e., stone slabs), positioned above and attached to a plurality of spaced apart joists 14 (one of which is shown) that support deck members 12 to form deck 10. Deck members 12, having first side 13*a,* opposing second side 13*b,* top 13*c* and bottom 13*d,* are typically made out of wood. As discussed above, deck members 12 can be made out of a concrete composite material, such as concrete mixed with plastic, sawdust or other materials that is then formed into a board shape (i.e., a two-by-four) member 12. Generally, the outer surfaces of the composite deck members 12 are contoured and configured to resemble natural wood or stone products. The builder of deck 10 obtains sufficient quantity of deck members 12 to cover the area where the deck 10 is to be placed. Typically, a deck 10 made out of wooden deck members 12 utilizes nails, screws or bolts to connect deck members 12 to joist 14 by driving or placing the connectors through the individual deck members 12 into joist 14. With composite board-shaped members 12, however, this is typically not possible or practical. Instead, a layer of adhesive (shown as 16 in FIG. 1) is placed on top of joist 14 or the bottom 13*d* of deck member 12 so as to be between the deck members 12 and the joist 14. The adhesives for use with the present invention are well known in the industry and commonly known. The deck members 12 are then placed on the adhesive 16 and are left to dry or cure. The integrity of the decking system for concrete composite members utilizing the system of installation of the prior art relies on the ability of the adhesive 16 to sufficiently bond deck members 12 to joist 14. Unfortunately, this bond often weakens as the wood framing expands and contacts over time, resulting in deck members 12 becoming loose. The loosening of deck members 12 requires repair or replacement of deck 10.

Figure 2:
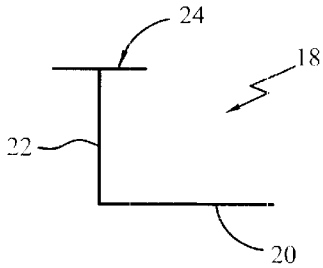
FIG. 2 is a side view of the connector shown in FIG. 1.
Figure 3:
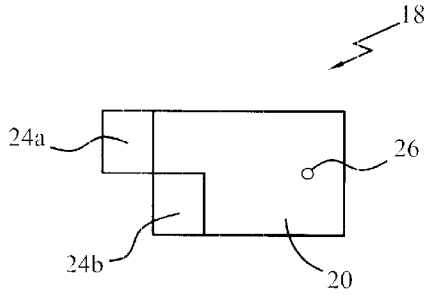
FIG. 3 is a top view of the connector in FIG. 2.
Figure 4:
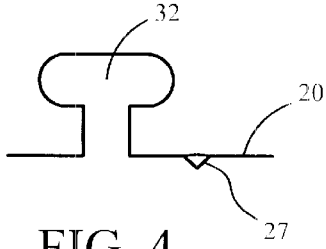
FIG. 4 is a side view of an alternate embodiment of the connector shown in FIGS. 2 and 3.

To improve the integrity of a deck 10 utilizing deck members 12 made out of composite materials, the present invention utilizes a plurality of clip members 18 to mechanically attach deck members 12 to joist 14. As shown in FIG. 1, clip members 18 are utilized between adjoining deck members 12 and between deck members 12 and joist 14. As shown in FIGS. 2 and 3, one configuration for clip member 18 is the use of an elongated base portion 20, vertical portion 22 and one or more insert portions 24 (FIG. 2 shows the use of two opposite facing insert portions 24*a* and 24*b*). Base portion 20 can include a hole 26, sized for a nail, screw, bolt or other connector 30, for use in attaching clip member 18 to joist 14. Alternatively, base portion 20 of clip member 18 can include an integral attachment or connector portion (shown in FIG. 4 as 27) protruding downward from base portion 20 that is suitable for attachment to joist 14. If a flush surface is desired for base portion 20, hole 26 can be contoured such that the top of the connector 30 (i.e., the head of a nail) will be flush with base portion 20 after it is driven or placed through joist 14.

In use, insert portion 24*ab* of clip member 18 is inserted into a slot 28 located on side 13*b* of first deck member 12*a* already in place on joist 14 such that vertical portion 22 abuts against side 13*b* of deck member 12*a*. Slot 28 can extend the entire length of the deck members 12 or be spaced a distance apart approximately equal to the spacing of the joists 14. A nail or other connector 30 is inserted through hole 26 and into joist 14. An adjoining second deck member 12*b* is placed along side the first deck member 12*a* such that insert portion 24*b* extends into slot 28 and the bottom 13*d* of the second deck member 12 is over base portion 20. First side 13*a* of second deck member 12*b* can either abut vertical portion 22 of clip member 18 and second side 13*b* of the first deck member 12*a* or a gap can be provided between the two deck members 12*a* and 12*b* so that grout material can be placed therebetween. The deck member 12 on the outer edge of deck 10 placed on joist 14 can either use a modified clip member 18 having only a single facing insert member 24*b* (i.e., a C-shaped clip member) or a clip member 18 with one portion of the insert member 24*a* broken off. The deck system 10 of the present invention using clip member 18 can also be utilized with adhesive layer 16 to provide a deck system which has deck members 12 even more securely attached to joist 14. The use of adhesive 16 also provides a cushioning effect for clip members 18, even after the adhesive 16 loosens over time from the natural expansion and contraction of the wood joist 14. Clip members 18 are placed between each deck member 12 at every joist 14 that make up the complete deck 10.

Clip member 18 can be made from a variety of materials having a variety of sizes and configurations. One material found suitable for this purpose by the inventor is 0.060 (1/16") gauge galvanized metal. For ease in manufacturing, clip member 18 can be made from a generally rectangular piece of metal that is cut to form the separate insert portions 24*a* and 24*b* and then bent at the appropriate places to form base portion 20, vertical portion 22 and insert portions 24. In one configuration, the inventor has found that an insert portion 24*a* and 24*b* of one-fourth to one-half inch width is sufficient to provide the needed support to anchor deck members 12 to joist 14. Alternatively, clip member 18 can be configured to different sizes and/or shapes. One such alternative, shown in FIG. 4., uses an oval-shaped insert portion 32. Alternatively, insert portion 32 can be rectangular or otherwise shaped to fit into slot 28 of deck members. If a different configuration for clip member 18 is to be used, the configuration of slot 28 could be modified to best match clip member 18 to ensure clip member 18 provides the mechanical support desired.

Figure 5:
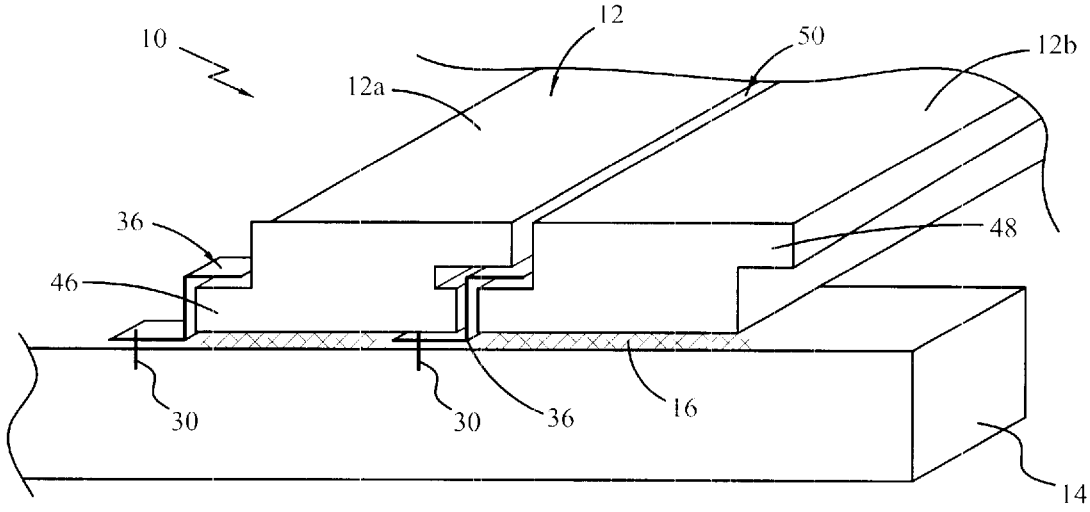
FIG. 5 is a perspective view of the use of a deck portion utilizing stone slabs and a connector of the present invention.
Figure 6:
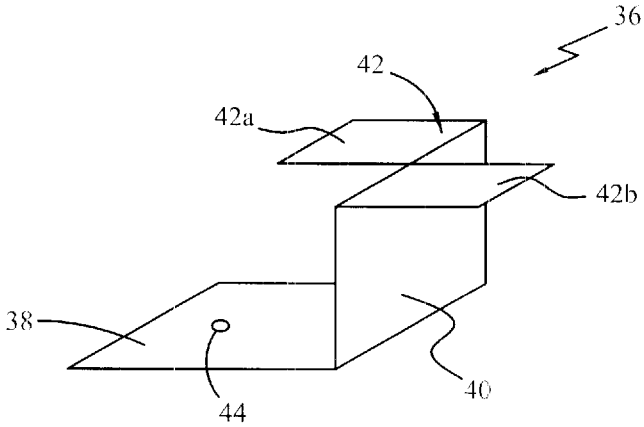
FIG. 6 is a perspective view of the connector illustrated in FIG. 5.

Another embodiment of the above-grade decking system of the present invention is shown in FIG. 5. In this embodiment, deck 10 has a plurality of adjoining deck members 12, comprising at least a first deck member 12*a* and a second deck member 12*b* in the shape of wood or stone materials, that are attached to joist 14 with an adhesive layer 16 and a clip member 36. The use of adhesive 16 alone with the deck members 12 has the same problems described above (i.e., they loosen over time). Clip member 36 is made out of the same materials as clip member 18 and comprises a base portion 38, vertical portion 40 and insert portion 42. Located on base portion 38 can be a hole 44, which can be contoured as discussed above, for allowing connector 30 (i.e., a nail) to be attached to joist 14. The use of an adhesive layer 16 with clip member 36 provides integrity support and a the cushioning effect described above. One configuration for clip member 36 is a 1" base portion 38, 5/8" vertical portion 40 and 1/2" insert portion 42.

In use, clip member 36 is placed between adjacent deck members 12*a* and 12*b*, which are placed on a layer of adhesive material 16, such that insert portion 42*b* is on top of lower extension 46 of second deck member 12*b*. A nail 30 or other connector is driven through hole 44 in base portion 38 and into joist 14 to mechanically connect deck member 12*b* to joist 14. The first deck member 12*a* is placed adjacent to the second deck member 12*b* such that the bottom of first deck member 12*a* is placed on top of base portion 38 and its side abuts vertical portion 40. Insert portion 42*a* extends into slot 28 on deck member 12*a* and the upper extension 48 of deck member 12*a* is placed on top of insert portion 42*b*. In some installations, it is preferable that upper extension 48 does not abut the adjacent deck member 12*b* so that gap 50 is created for placement of grout between the deck members. Alternatively, deck members 12*a* and 12*b* can abut each other. The above procedure is repeated throughout the joists 14 and deck members 12 used to form deck 10.

Figure 7:
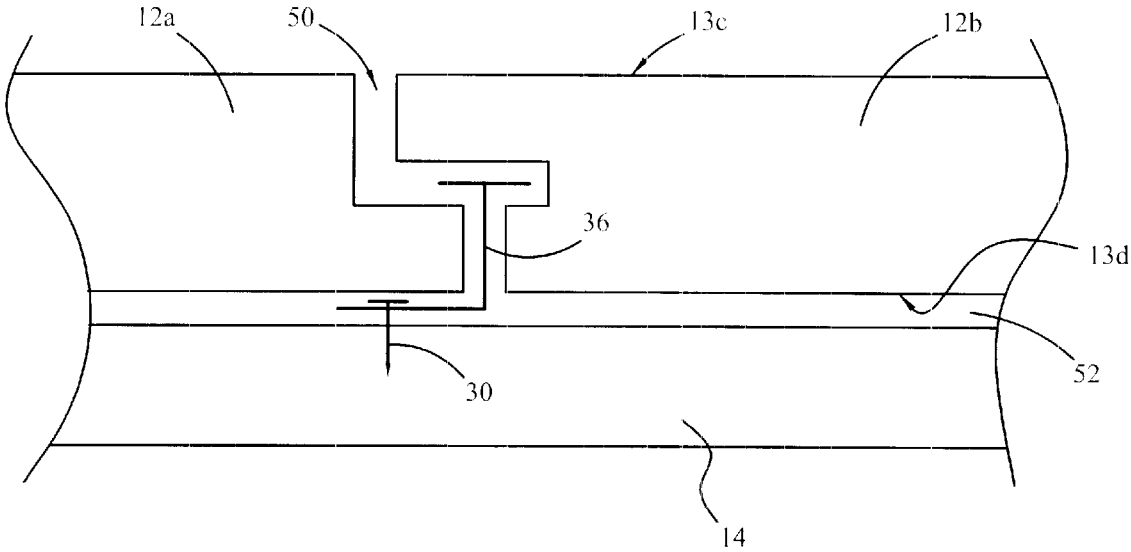
FIG. 7 is a side view of an alternative embodiment of the present invention.

Another alternative configuration for the present invention, shown in FIG. 7, a plywood member 52, or other types of wood material, disposed between deck members 12 and joist 14 to reduce the overall weight of the deck 10 (by utilizing thinner deck members 12). A connector 36, held in place with nail 30 that goes through plywood member 52 into joist 14, provides mechanical support to deck members 12. As with the embodiments described above, an adhesive (not shown) can be used between deck members 12 and plywood 52 and/or between plywood 52 and joist 14.

Figure 8:
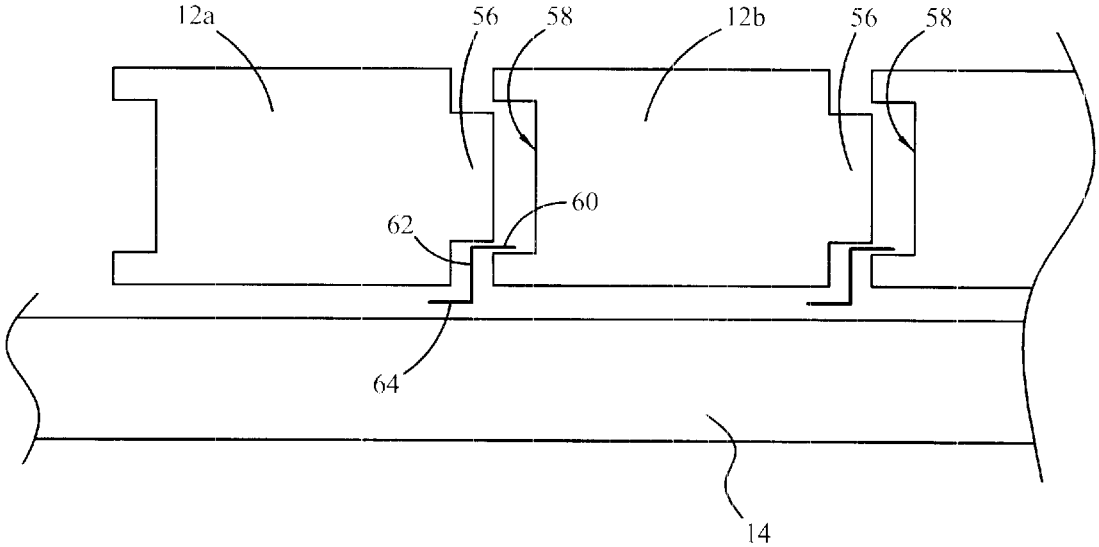
FIG. 8 is a side view of an alternative embodiment of the present invention.

Another embodiment of the present invention is illustrated in FIG. 8. In this embodiment, the adjoining deck members 12*a* and 12*b* are shaped and configured to fit together with a clip member 54 that is shaped to take advantage of the deck members 12 fitting together. Each deck member 12 has a protruding segment 56 on one side (i.e., first side 13*a*) and a recessed segment 58 on the opposite side (i.e., second side 13*b*), as shown in FIG. 8. The protruding segment 56 is shaped and configured to be received into the recessed segment 58 when the two adjoining deck members 12*a* and 12*b* are placed side by side. The clip member 54 has an insert portion 60 that comprises a single portion that extends the opposite side of vertical member 62 as the base portion 64 (forming a s-like shape) that is configured to be inserted between the protruding segment 56 of one deck member 12*a* and the recessed segment 58 of the adjoining deck member 12*b*.

Although the deck system 10 of the present invention works best for composite concrete materials shaped and configured to resemble wood or stone products, due to the weight of the material bearing down on the joists, it can also be utilized with wood members. For instance, deck members 12 made out of wood can be cut on the sides to form the slots 28 shown in FIG. 1 so the clip member 18 can be utilized with the deck 10. The advantage of utilizing the present system 10 over traditional mechanisms for connecting deck members 12 to joists 14 is the elimination of the nail head, or equivalent top of connector 30, from being visible from and extending above top surface 13*c* of deck 10.

While there are shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape, and use. For instance, there are numerous components described herein that can be replaced with equivalent functioning components to accomplish the objectives of the present invention. One such modification is the use of different materials than those set forth herein. Another modification would be a change in the dimensional characteristics of the various components.

What is claimed is:

1. An above-grade decking system, comprising:

a plurality of spaced apart joists;

a plurality of adjoining deck members comprising at least a first deck member and a second deck member, each of said deck members placed on at least one of said plurality of spaced apart joists, each of said deck members having a first side, an opposing second side, a top surface and a bottom surface, said second side of said first deck member having said slot therein and adjacent said first side of said second deck member, said first side of second deck member having said slot therein; and a clip member having at least a base portion, a vertical portion and an insert portion, said clip member sized and configured such that said insert portion is disposed in each of said slots in said second side of said first deck member and said first side of said deck member when said base portion is disposed between said bottom surface of said deck member and said joist and said vertical member is disposed between said adjoining deck members.

2. The deck system according to claim 1 further comprising an adhesive between said deck members and said joist.

3. The deck system according to claim 1, wherein said base portion of said clip member has at least one opening configured to receive therein a connector to connect said clip member to said joist.

4. The deck system according to claim 1 further comprising an integral connector on said base portion of said clip member.

5. The deck system according to claim 1, wherein said slot extends the length of said deck member.

6. The deck system according to claim 1, wherein said deck member is a concrete composite material shaped and configured into a board member.

7. The deck system according to claim 1, wherein said deck member is a concrete composite material shaped and configured into a stone member.

* * * * *